US006924015B2

(12) United States Patent
Zanchetta et al.

(10) Patent No.: US 6,924,015 B2
(45) **Date of Patent: *Aug. 2, 2005**

(54) MODIFIED BITUMEN ROOFING MEMBRANE WITH ENHANCED SEALABILITY

(75) Inventors: Natalino Zanchetta, Reno, NV (US); Shaik Mohseen, Mountain Top, PA (US)

(73) Assignee: Polyglass, U.S.A., Fernley, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/152,261

(22) Filed: May 21, 2002

(65) Prior Publication Data

US 2003/0219563 A1 Nov. 27, 2003

(51) Int. Cl.[7] ..... B32B 11/04

(52) U.S. Cl. ..... 428/40.1; 52/177; 52/181; 428/40.2; 428/40.3; 428/41.3; 428/42.1; 428/42.2; 428/143; 428/147; 428/192; 428/194; 428/356; 428/492

(58) Field of Search ..... 428/40.1, 40.2, 428/40.3, 41.3, 42.1, 143, 147, 192, 194, 356, 492, 42.2, 41.9, 41.7, 41.8; 52/177, 181

(56) References Cited

U.S. PATENT DOCUMENTS

| | | | |
|---|---|---|---|
| 3,581,779 A | 6/1971 | Sylvia, Jr. | 138/141 |
| 4,396,665 A | 8/1983 | Rowe | 428/148 |

(Continued)

FOREIGN PATENT DOCUMENTS

BE 1005075 A3 * 4/1993

OTHER PUBLICATIONS

PLURA: The New Generation of Waterproofing Membranes, Apr. 03, 2002, www.pluvitec.com.

PLURA AD Self Adhesive, Apr. 03, 2002, www.pluvitec.com.

EXTRATEC, Apr. 03, 2002, www.pluvitec.com.

PLURA HP, Apr. 03, 2002, www.pluvitec.com.

PLURA AD Self Adhesive, Apr. 03, 2002, www.pluvitec.com.

Torch–On Roofing and Waterproofing, Apr. 03, 2002, www.halind.com.

(Continued)

*Primary Examiner*—Nasser Ahmad

(74) *Attorney, Agent, or Firm*—David I. Roche; Baker & McKenzie LLP

(57) ABSTRACT

A self-adhering modified bituminous roof covering composite that comprises a thermoplastic (APP), elastomeric (SBS) or TPO modified bitumen compound on the front side, and a factory-applied self-adhesive compound on the back side of a reinforcement carrier sheet, with factory-applied tracts of adhesive on the side lap and end lap sections of each roll to enhance adhesion. A method of manufacturing such composite comprising coating an APP or SBS or TPO compound on the upper surface and affixing a self-adhesive compound to the lower surface of a reinforcement carrier support sheet, coating an adhesive on the side lap and end lap areas, applying a release liner to the tacky self-adhesive layer, and applying release films to the side and end laps during manufacture, stripping the release liner, selvage release film and end lap film from the membrane immediately prior to use, subsequently placing the exposed self-adhesive side of the membrane directly on to the end lap areas and side lap areas of adjacent rolls and applying force directly to the sheet to enhance the bond between the two sheets, resulting in a continuous roof covering. The present invention relates generally to residential and commercial roofing membranes.

12 Claims, 4 Drawing Sheets

U.S. PATENT DOCUMENTS

| | | | | | |
|---|---|---|---|---|---|
| 4,670,071 | A | | 6/1987 | Cooper et al. | 156/71 |
| 4,992,315 | A | | 2/1991 | Zickell et al. | 428/40 |
| 5,118,550 | A | | 6/1992 | Baravian et al. | 428/90 |
| 5,143,766 | A | | 9/1992 | Wenz et al. | 428/40 |
| 5,686,703 | A | * | 11/1997 | Yamaguchi | 428/356 |
| 5,687,517 | A | | 11/1997 | Wiercinski et al. | 52/177 |
| 5,766,729 | A | | 6/1998 | Zanchetta et al. | 428/143 |
| 5,843,522 | A | | 12/1998 | Zanchetta et al. | 427/186 |
| 5,916,654 | A | | 6/1999 | Phillips et al. | 428/42.2 |
| 5,964,946 | A | | 10/1999 | Zanchetta et al. | 118/663 |
| 6,080,458 | A | | 6/2000 | Russell et al. | 428/41.7 |
| 6,209,283 | B1 | | 4/2001 | Folkerson | 52/746.11 |
| 6,296,912 | B1 | | 10/2001 | Zickell | 428/40.1 |
| 6,360,506 | B1 | | 3/2002 | Graae | 52/408 |
| 6,696,125 | B2 | * | 2/2004 | Zanchetta | 428/40.1 |

OTHER PUBLICATIONS

Tech 3000, Apr. 03, 2002, www.pluvitec.com.
Tech 5000, Apr. 03, 2002, www.pluvitec.com.
Tech 1000, Apr. 03, 2002, www.pluvitec.com.
IPERTEC, Apr. 03, 2002, www.pluvitec.com.
SUPERTEC, Apr. 03, 2002, www.pluvitec.com.
MAXITEC—anti–root, Apr. 03, 2002, www.pluvitec.com.
MAXITEC, Apr. 03, 2002, www.pluvitec.com.
MAXITEC—viaducts, Apr. 03, 2002, www.pluvitec.com.
MAXITEC—vapour–barrier, Apr. 03, 2002, www.pluvitec.com.
IKO "What's New", Mar. 29, 2002, www.iko.com.

* cited by examiner

MODIFIED BITUMEN ROOFING MEMBRANE WITH ENHANCED SEALABILITY

BACKGROUND AND SUMMARY OF THE INVENTION

This invention relates to bituminous roofing adapted for the waterproofing and sealing of substrate structures and to the method of manufacturing such materials. More particularly, the present invention is in the field of roofing membranes having a factory-applied self-adhesive layer on the bottom surface and a thermoplastic modifier such as Atactic PolyPropylene (APP) modified bituminous compound or an elastomeric modifier such as Styrene-Butadiene-Styrene (SBS) modified bituminous compound on the upper surface, and an adhesive coating on the overlap sections of the weathering (upper) surface of modified bitumen roofing membranes to which the underside of a succeeding sheet of membrane may be adhered in order to provide good sealability in addition to easy and hassle-free field application by roofing personnel.

It is well known to use bituminous compositions for manufacturing waterproofing membranes, generally for roof covering and roofing underlayments. Modified bituminous prepared roofing, also referred to as modified asphalt roofing membrane, is typically manufactured using, as a core, a reinforcement carrier support sheet made of fabric such as polyester, fiberglass, or a combination of both, saturating and coating the front and back sides of the carrier with a modified bituminous coating material based on Atactic PolyPropylene (APP), Amorphous Poly Alpha Olefin (APAO), Thermoplastic PolyOlefin (TPO), Styrene-Butadiene-Styrene (SBS), Styrene-Ethylene-Butadiene-Styrene (SEBS), synthetic rubber or other asphaltic modifiers, that will enhance the properties of asphalt.

Of the two most common types of bituminous sheet materials used for roofing applications, i.e., bitumen-SBS and bitumen-APP materials, the bitumen-SBS products are more elastic, have greater flexibility at low temperatures. APP-based products, however, are more heat-resistant (due to a higher softening point), are more resistant against the effects of the atmosphere (especially ultra-violet rays) and more resistant to foot traffic.

Whereas APP modified roofing membranes are usually torched and SBS modified roofing membranes are usually hot mopped, there exists another class of membranes called "self-adhered", that are based on APP or SBS. These membranes are generally made using dual compound technology-APP or SBS compound on the top surface and a self-adhesive compound on the bottom surface. The manufacture of bituminous roofing material with multiple layers is well-known. For example, U.S. Pat. Nos. 2,893,889; 4,755,409; 4,871,605; and EP Patent No. 903435 disclose membranes comprised of a core and a plurality of different layers of waterproofing material. The '409 patent also discloses a release sheet applied to the one side of the membrane for purposes of protection. Products are in the market which combine the more flexible and elastic bitumen-SBS upper layer with a self-adhesive lower surface. An example of such a product is Plura AD self-adhesive sold by Pluvitec S.p.A., described on the website of the seller at http://www.pluvitec.com. Furthermore, it is known in the prior art to join two roofing membranes in order to effect sufficient sealing and waterproofing. For example, U.S. Pat. No. 6,360,506, discloses a membrane containing two bitumen strips used for joining two separate roofing membranes.

In applications in which more than one course of the membrane is applied to the roof deck or underlayment, adjacent rolls need to be adhered to each other by overlapping in offset pattern at the end laps (widthwise) and at side laps (lengthwise). If employed, these laps must be watertight and also possess a high degree of structural integrity. Of course, if an effective seal is not attained, the membrane system will leak and therefore, not achieve its very purpose. It is a known fact that the weakest points on a continuous roof are the lap joints. Whereas these laps are sealed by heat welding in the case of torch-grade products and using hot asphalt in hot-mopped products, lap seal for membranes in this invention is achieved by sticking the self-adhesive compound to the upper surface of the membrane. This seal is immediate and becomes irreversible when activated by heat and pressure.

As part of the present invention a pressure sensitive adhesive is preferably applied on the overlap areas, namely the end lap and side lap, of the roofing membrane in order to provide an instantaneous bonding between the two surface layers and to improve the bonding strength especially in cold weather conditions. The adhesive layer is applied on the upwardly facing selvage edge (i.e., the side lap) along the length of the sheet with the adhesive preferably, but not necessarily, spaced inwardly of the outermost edge. The adhesive layer is similarly applied on the upwardly facing trailing edge portion of the upper layer (i.e., the end lap) across the width of the sheet. The adhesive on the upwardly facing portion of the end lap is protected using a 4 to 6 inch wide siliconized film and the adhesive on the side lap is protected using a 3 to 4 inch wide siliconized film. In use, when the membrane is secured to the roof, the leading edge of a new roll in a row is placed onto the end lap of a previously laid roll in that row after removal of the release liner. The upper layer with the upwardly facing adhesive edges constitutes a starter strip for receiving thereon the adjacent rolls of roofing membranes. Similarly, when forming a new row, a release liner is removed from the side lap of the rolls in an existing row of membranes, and the self-adhesive underside of a new roll is placed on the adhesive-bearing portions of the previously laid rolls, i.e., the edges exposed by the removal of the release liner. Within the above-described scope the goal of the invention is to provide membranes that are impermeably sealed to adjacent or contiguous membranes in an effective and aesthetically pleasing manner. The membrane that is the subject of this invention provides a reliable seal between membranes because of its unique design features. The subject bitumen based membrane is easy to produce because it is made of elements and materials that are available on the market. Further, the membrane of the present invention is relatively inexpensive to manufacture and install.

This invention is preferably implemented by using a "dual compound" to the reinforcement carrier sheet—a compound based on Atactic PolyPropylene (APP), Amorphous Poly Alpha Olefin (APAO), Thermoplastic PolyOlefin (TPO), Styrene-Butadiene-Styrene (SBS), Styrene-Ethylene-Butadiene-Styrene (SEBS), synthetic rubber or other asphaltic modifiers on the top surface, and a separate heat-and-pressure-activated adhesive compound to the bottom surface of the reinforcement carrier sheet. The membranes in this invention are characterized by the fact that they include an end lap and a side lap, which consist of a tract of exposed bitumen, free of granular material with an adhesive strip on the end laps and side laps of the upper surface of the membrane to facilitate easy and excellent adhesion. This invention applies to self-adhesive membranes based on dual-compounding technology that constitute cap sheets such as APP modified and SBS modified, base sheets such as APP modified and SBS modified, and underlayments such as employed under tile roofing and metal panels.

APP modified compound utilized on the upper layer offers plastomeric characteristics to the bitumen and makes the membrane hard and imparts improved flow resistance at high temperatures. A release liner, typically made of polypropylene, polyethylene or polyester, of thickness ranging from 40 to 80 microns, and treated with a silicone adhesive on one side (the side that comes in contact with the self-adhesive compound), is applied to the self-adhesive compound to prevent sticking of adjacent sections of the roofing material and to the packaging when the finished membrane is stored and transported in the form of rolls.

The present invention involves roof coverings in the form of roofing membranes having an upper layer of a modified bituminous compound, whose composition utilizes bitumen (asphalt), modifiers and fillers, and a lower layer of a self-adhesive compound, whose composition utilizes bitumen (asphalt), elastomeric modifiers, tackifying resins, and fillers. A typical APP compound may contain 5% to 25% of polypropylene modifiers, 8% to 70% of filler such as limestone, talc, fly ash, volcanic ash, graphite, carbon black, silica or china clay, and remaining portions of asphalt. In order to achieve fire ratings as classified by Underwriters' Laboratories (UL), special fire retardant additives may be used as filler. A typical SBS compound may contain 4% to 16% of Styrene-Butadiene-Styrene modifiers, 8% to 70% of filler such as limestone, talc, fly ash, volcanic ash, graphite, carbon black, silica or china clay, and remaining portions of asphalt. In order to achieve fire ratings as classified by Underwriters' Laboratories (UL), special fire retardant additives may be used as filler. A typical self-adhesive compound may contain 3% to 10% of Styrene-Butadiene-Styrene modifiers, 0% to 5% of Styrene-isoprene-styrene modifiers, 6% to 25% of hydrocarbon tackifying resins, 8% to 40% of filler such as limestone, talc, fly ash, volcanic ash, graphite, carbon black, silica or china clay, and remaining portions of asphalt.

The inventive membrane has a carrier that supports a dual compound modified asphalt, namely, an APP modified or SBS modified asphaltic compound, which is positioned on top of the carrier sheet, and a self-adhesive modified asphaltic compound, which is positioned below the carrier sheet. The adherent material serves to affix the membrane to the roof deck, base sheet or underlayment.

In order to provide adhesion and a watertight seal between the self-adhesive compound on the lower surface of the membrane and the modified bitumen compound on the upper surface, an adhesive that is compatible with both the modified bituminous coating layers must be utilized on the overlap areas. For this purpose, the adhesive selected should be compatible with the self-adhesive compound utilized on the back surface of the membrane One choice for adhesive could be the self-adhesive compound applied on the back side of the membrane. Alternatively, tackifiers such as Poly Vinyl Butyral (PVB) used in formulating the self-adhesive compound can be used. PVB is primarily used as an interlayer between car windshield glass. Use of PVB helps reduce the possibility of 'shattering of glass' in the case of accidents and also provides good sound dampening properties. Each year, millions of pounds of PVB are discarded after use. Monsanto is one company that has perfected a process of removing the car windshield glass so that they could preserve the PVB layer sandwiched between the glass layers. Other choices for this application are Pressure sensitive adhesives (PSA) that are commercially available. PSAs are based on silicones, rubber or acrylates. For this application a Styrene-Isoprene-Styrene (SIS) rubber based adhesive is preferred because of its superior low temperature tack and low cost. PSA selected for this use is manufactured and sold by Forbo Adhesives (formerly Reichhold Corporation), Research Triangle Park, N.C., under the trade name of PSA 81570. These adhesives have excellent tack properties at low temperatures, which is very critical for this application. These are fast setting adhesives, designed for good performance and good machining at high production speeds. This PSA is used for both APP based and SBS based modified bituminous membranes.

Using an adhesive applicator, typically 2–3 strips of adhesive are applied on the lap areas in the form of swirls that are 0.5 inch to 1.5 inch in width each. In order to achieve good bonding between adjacent layers, a minimum of 40 grams of adhesive per 10-meter long roll is preferred. This pressure sensitive adhesive provides excellent surface tack as well as adequate strength for use in self-adhered roofing application.

DETAILED DESCRIPTION

In one preferred embodiment, the modified bitumen membrane is a dual compound composition constructed of a first APP or SBS modified asphaltic layer on the front side of the carrier sheet and a second self-adhesive asphaltic layer on the back side of the carrier sheet. The second asphaltic layer is very adherent and provides excellent adhesion of the membrane to the underlying surface. Strips of adhesive are applied on the side lap and end lap areas to enhance bonding strength.

Figure 1:
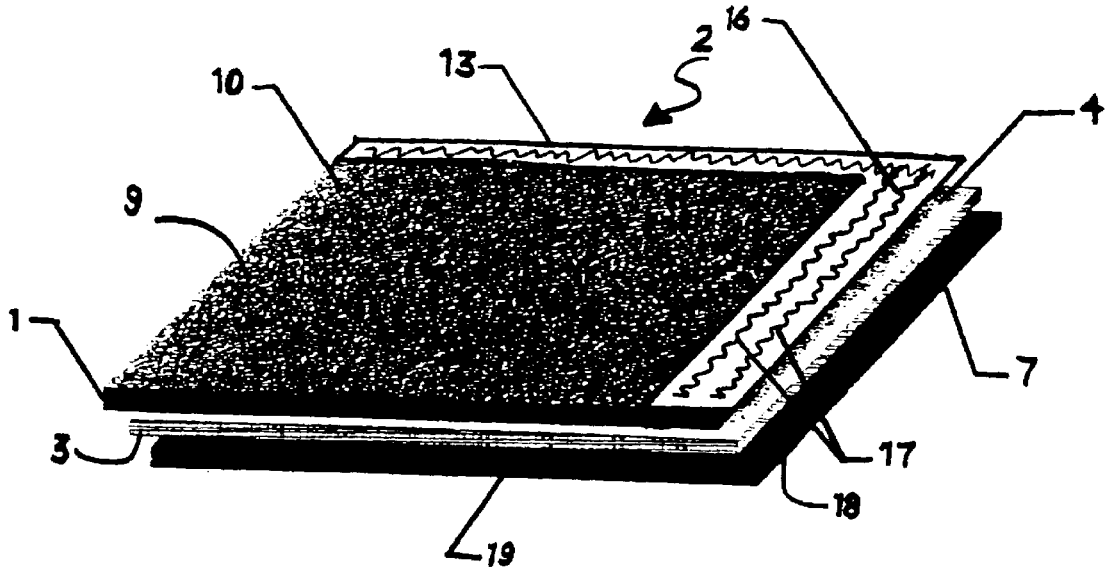
FIG. 1 is an exploded view of the roofing membrane composite sheet.

Referring now to the drawings, FIG. 1 represents a bituminous self-adhesive membrane constructed in accordance with the present invention and is shown in an exploded view. The composite sheet 2 is made with modified asphalt coatings and a reinforcing carrier sheet 4. Specifically, composite sheet 2 includes a reinforcing carrier 4 sandwiched between upper and lower layers, 1 and 7, respectively, of modified bitumen coatings, which form oppositely exposed upper and lower surfaces, 9 and 18, respectively, of the composite sheet 2. The lower layer 7 has an adhesive polymer-modified compound that constitutes a non-weathering surface adapted to be secured to the underlying surface. The upper layer 1 is an APP compound (described in detail later in the description) and the lower layer 7 is a separate, but compatible, self-adhesive compound (also described in detail later in the description). Between the upper and lower layers, 1 and 7 respectively, is a reinforcing carrier sheet core 4, preferably made of a fiberglass or polyester substrate. Alternatively, the reinforcing carrier sheet 4 may be formed of a composite material that is a combination of both polyester and fiberglass creating a stronger reinforcement carrier sheet 4. As will become hereinafter apparent, the lower exposed surface 18 of the lower layer 7 is a non-weathering surface adapted to be adhered directly to the underlying surface. Surfacing agents 10, such as roofing granules, talc or sand for cap sheets and base sheets, fabric surfacing for metal underlayments or mineral granules for tile underlayments, are applied to the upper surface of the upper asphaltic coating layer 1 to impart weathering, high temperature resistance and skid resistance. Roofing granules are made of naturally occurring base rock material and are commonly known as quartz or crystalline silica. Talc used is another naturally occurring material that is predominantly Calcium Carbonate. Sand utilized for this application is chemically classified as crystalline silica. Lightweight polyester or polypropylene fabric material with no binder is used to cover the top surface of metal roofing underlayments. All of the above surfacing materials are commercially available.

A siliconized film, called selvage release film 12, that is approximately 3 to 4 inches in width, is placed along the length of the roll on one side of the composite sheet 2, forming a side lap 13. This allows for overlapping one roll over another widthwise. Similarly, a siliconized polyester end lap film 15, that is 4 to 6 inches in width, is positioned across the width of the sheet at regular intervals to provide a granule-free end lap 16. For more detail on the end lap protection of a roll of roofing membrane see U.S. Pat. Nos. 5,843,522 and 5,766,729, which are assigned to the assignee of the inventions described herein and which are incorporated by reference herein. The protected end lap 16 feature allows a granule-free surface at the end of each roll and facilitates easy installation when overlapping one roll over another lengthwise. Additionally, the side lap 13 feature allows a granule-free surface on the selvage of each roll and facilitates easy installation when overlapping one roll over another widthwise.

It is well known that modified bitumen based roofing materials are used all over the United States throughout the year. It is also known that the required bonding strength is achieved in products based on self-adhesive technology in the presence of heat and pressure, which act as catalyst to attain a permanent seal. However, when these products are used during colder climatic conditions, the element of "heat" is lacking or insufficient. Whereas it is possible to recommend the use of a hot air gun to activate the adhesive at the lap seams, this technique is time consuming. By the application of a thin layer or adhesive coating 17, i.e., a width of adhesive coating, consisting of a tackifying resin or commercially available pressure-sensitive adhesive (PSA) or PolyVinyl Butyral (PVB) to the side lap 13 and end lap 16, a good initial seal between adjacent rolls is obtained. The initial seal is adequate to last at least until the warmth of a summer season brings heat sufficient to permanently bond the entire lap joint. This feature allows the application of such membranes under low temperature conditions, without compromising the integrity of the roof, and without the time, danger and expense of field-applied heat.

Preferred formulations for the self-adhesive lower layer 7 of the present invention, in applications where the upper layer 1 is an APP modified bituminous materials are set forth in Table 1.

TABLE 1

| | Formulation Without PVB (% by Weight) Preferred | | | Formulation With PVB (% by Weight) Preferred | | |
|---|---|---|---|---|---|---|
| Ingredients | Membrane | Min | Max | Membrane | Min | Max |
| Asphalt | 63 | 57 | 69 | 72 | 67 | 77 |
| Filler | 0 | 0 | 0 | 11 | 8 | 40 |
| SBS | 5 | 3 | 10 | 5 | 3 | 10 |
| SIS | 6 | 4 | 11 | 0 | 0 | 5 |
| Tackifiers | 26 | 20 | 33 | 8 | 4 | 16 |
| PVB | 0 | 0 | 0 | 4 | 2 | 9 |

The adhesive coating 17 on the side lap 13 and end lap 16 may be in the form of a thin coating, but two strips of adhesive coating is preferred, one acting as a back-up for the other, to ensure good bonding and sealing against water infiltration. It is preferable to have a thin layer of this adhesive in order to provide maximum surface area of contact between the two layers.

Positioned on the lower exposed surface 18 of the lower adhesive asphaltic layer 7 is a release liner 19 of preferably silicone treated polypropylene, polyethylene or polyester. Of course, during application to the underlying surface 5 or roof deck, the release liner 19 is removed, thereby allowing the sticky lower-exposed surface 18 of the composite 2 to adhere to the roof or underlying surface 5. Also, release films are applied to the end lap 16 and side lap 13 to ensure the material surfaces do not stick with one another. A selvage release film 12 is applied to the side lap 13 and an end lap release film 15 is applied to the end lap 16. These films are also removed prior to application at the jobsite. The upper APP compound layer 1 of the composite sheet 2 can either be smooth surfaced or surfaced with a protective layer of surfacing agents 10, such as granules, as shown in FIG. 1. This upper exposed surface 9 constitutes a surface exposed to weather conditions, or possibly to other membranes or shingles when the membrane of the present invention is used as an underlayment.

The lower adhesive layer 7 of the dual-compound asphaltic coating is an aggressive adhesive layer that is applied on the backside 3 of the carrier sheet 4. The lower adhesive layer 7 should possess a reasonable shelf life and excellent adhesion characteristics and have sufficient surface tack for rooftop installation but yet should not be too sticky that one cannot remove the release liner 19 at high temperatures.

Tensile test was conducted to measure lap adhesion strength between adjacent sections of sheets with and without adhesive treatment on the lap areas. Testing was conducted in accordance with ASTM D5147 tensile testing requirements using an Instron tensile testing machine. The product used for testing was Polyglass' Polyflex SAP membrane (upper layer 1 of APP compound and lower layer 7 of self-adhesive compound). Samples were prepared by adhering the self-adhesive compound on the lower layer 7 to the APP selvage area (i.e., side lap 13) on the upper layer 1. Results obtained revealed significantly better bond strength with adhesive on the lap areas (Refer to Table 2). It is noteworthy that the failure on the samples with 40 grams of adhesive on the selvage occurred outside the sample overlap section.

TABLE 2

| Sample | RT Conditioning | 80 deg C. conditioning | 5 deg C. conditioning |
|---|---|---|---|
| No adhesive on side lap | 67.78 lbs/in | 87.73 lbs/in | 68.94 lbs/in |
| 20 grams adhesive on side lap | 78.53 lbs/in | 95.84 lbs/in | 80.35 lbs/in |
| 40 grams adhesive on side lap | 90.89 lbs/in | 102.60 lbs/in | 91.60 lbs/in |

A release liner 19, as described below, can be adhered to the self-adhesive compound lower layer 7 to protect the adhesive properties during production, transportation and storage of the composite sheets or membranes. The release liner 19 is typically a polyester, polypropylene or polyethylene film that is 40 to 70 micron in thickness and siliconized on the surface that contacts the self-adhesive compound lower layer 7. Optionally, a siliconized kraft paper or a composite of paper and film can be adhered to the adhesive portion of the composite sheet 2. The release liner 19 is removed prior to use of the composite sheet 2 to allow the adhesive portion to be adhered to a roof surface or other underlying surface 5. It is preferred that the release liner 19 be of white color on the exposed side so as to reflect solar energy and thereby keep the adhesive lower layer 7 relatively cool.

A polyolefinic film, based on polyethylene or polypropylene or polyester, covers the side lap 13 and end lap 16. The function of the side lap 13 and end lap 16 release films, 12 and 15, respectively, is to cover the asphaltic compound until the membrane is installed on the roof or other underlying surface 5, where these films are removed. When choosing the type of film, several factors need to be taken into consideration as follows: It is important to select a film that will not undergo any distortion during manufacturing. Also, the film should release with relative ease during installation of the material. Typically, during hot weather conditions, such films have a tendency to stick to the compound and tear when attempted to remove from the membrane. Another important parameter to consider is the appropriate thickness of the film. Thicker films are easier to release but could pose some problems during manufacture and are proportionally expensive. Another important factor is the quantity and quality of the release agent such as silicone that is applied on the film. Whereas polyester is the most expensive of these films, it offers the most heat resistance, which is very critical in this application. Thickness of such polyester film employed for this application can range from 0.5 mil (0.0125 mm) to 2 mil (0.050 mm); however a 1.5 mil (0.0375 mm) is preferred.

With the adhesive lower layer 7 being pre-applied, all that is required at the jobsite is for the applicator to unroll the composite sheet 2 and position it, fold one-half of the rolled out membrane back and strip away the release liner 19, place the now-exposed adhesive lower layer 7 onto the roof or underlying surface 5, and then apply pressure which can be accomplished merely by rolling using a metal roller that is at least 80 lbs in weight, and finally, folding the other half and removing the release liner 19, and adhering this section to the underlying surface 5 as stated above. Also removed at the time of roof covering installation are the selvage release film 12 and the end lap film 15.

Figure 2:
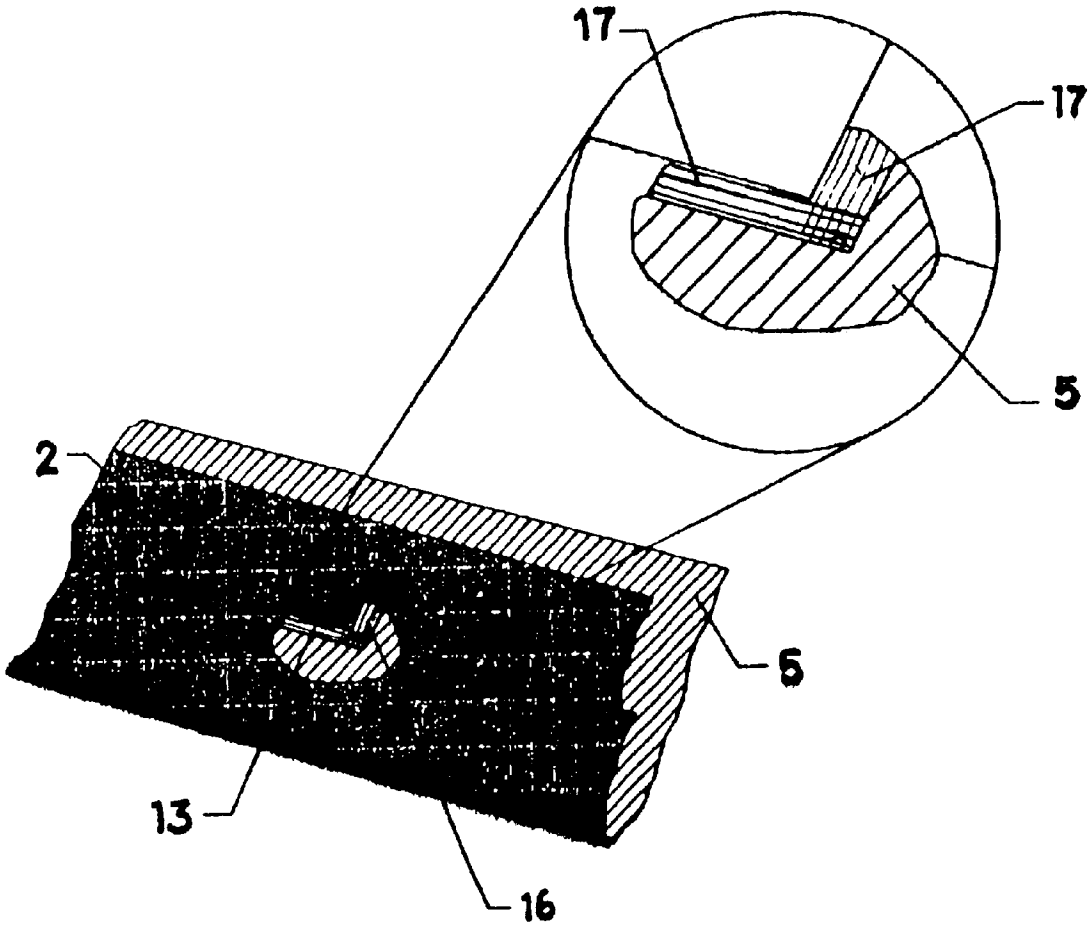
FIG. 2 is a top view of the composite sheet illustrating the adhesive strips on the side and end laps and adhered to a roofing substrate structure.

Referring now to FIG. 2, the composite sheet 2 is shown as applied to the underlying surface 5, which can be the roof deck itself or another base sheet or underlayment. The composite sheet 2 is shown with a cut-out exploded view illustrating the side lap 13 and the end lap 16. The side lap 13 runs longitudinally along one lengthwise edge of the composite sheet 2, whereas the end lap 16 runs transversely along one widthwise end of the composite sheet 2. As illustrated, the composite sheet 2 is applied to the underlying surface 5 in successive rows. The composite sheet 2 can be adhered to each other along the side lap 13 and end lap 16 with the adhesive coating 17 applied thereto, to create an immediate watertight or connecting bond between successive or adjacent composite sheets 2.

Figure 3:
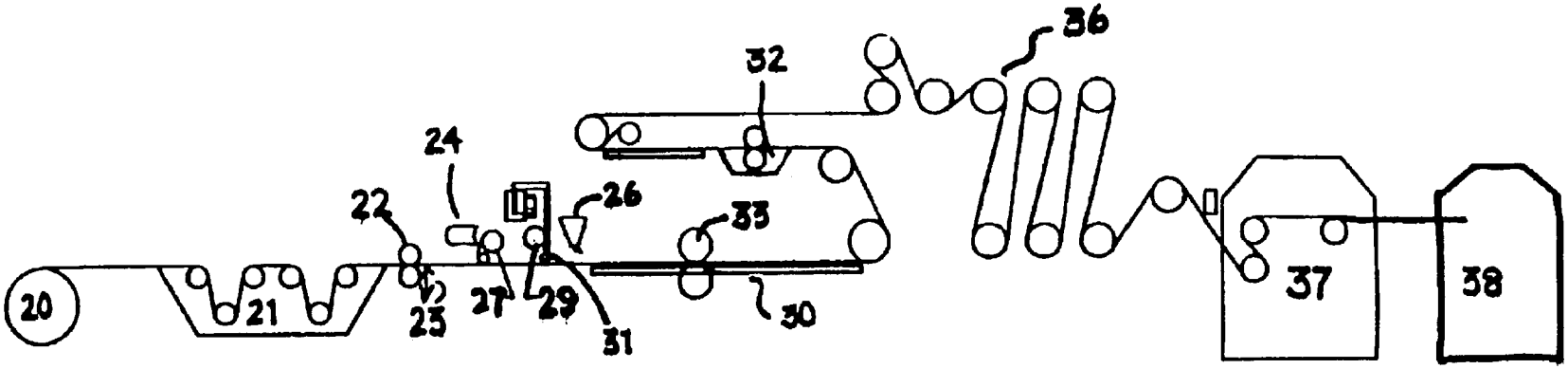
FIG. 3 is a view of the dual-compounding composite sheet manufacturing process and one method of applying the adhesive strips on the composite side and end laps.

FIG. 3 illustrates the process of manufacture of a dual compound modified bitumen composite 2 using a system to apply adhesive glue on the end lap 16 and side lap 13 of the composite 2. One or more reinforcement carrier sheets 4, which may be polyester, fiberglass, or a polyester/fiberglass combination, is unwound from a mat unwinding station 20, and saturated with the APP modified bitumen compound upper layer 1 in the saturation tank 21. Coating thickness is controlled using calender rolls 22 immediately after the saturated carrier sheet 4 comes out of the saturation tank 21. For this invention, compound from the carrier sheet back side 3 is scraped off using a scraper 23 in order to facilitate application of the self-adhesive compound lower layer 7 on the carrier back side 3 of the carrier sheet 4 during a later stage in the manufacturing process. FIG. 3 illustrates one method of applying the adhesive coating 17 to the side lap 13 and end lap 16. In this method, once the compound from the carrier sheet back side 3 is scraped off, the adhesive coating 17 is applied to the side lap 13 using a selvage adhesive applicator 24, which is followed immediately by application of a siliconized polyester film tape, called selvage film 12, that is typically 3 to 4 inches in width, to the side lap 13 of the composite 2 using a selvage film applicator 27. Then the adhesive coating 17 is applied to the end lap 16 using an end lap adhesive applicator 29, which is followed immediately by application of a siliconized polyester tape, called end lap film 15, that is typically 4 to 6 inches in width, across the width of the composite sheet 2 using an end lap film applicator 31.

Figure 4:
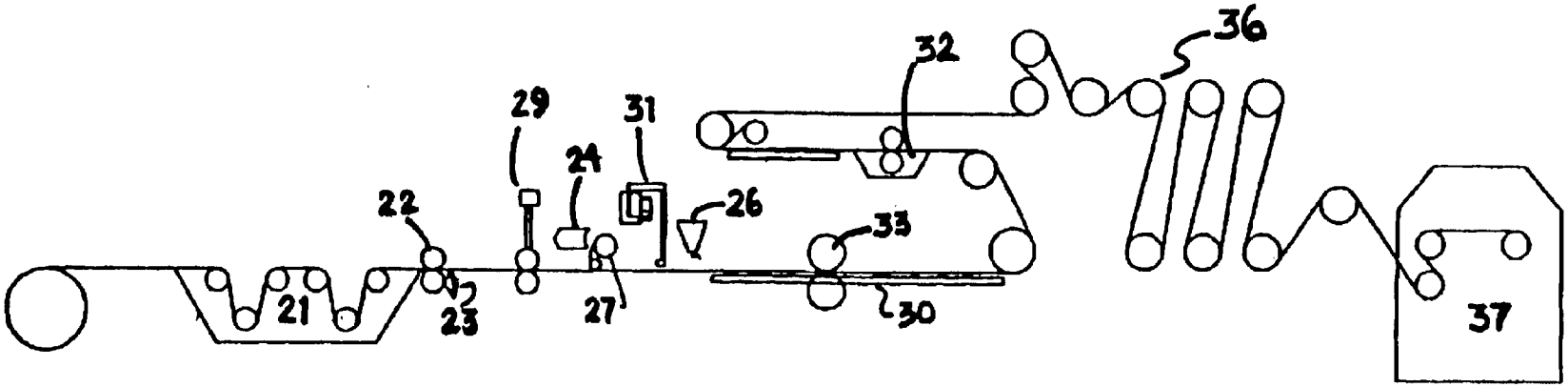
FIG. 4 is a view of the dual-compounding composite sheet manufacturing process and a second method of applying the adhesive strips on the composite side and end laps.

FIG. 4 illustrates another adhesive coating application technique. In this method, once the carrier 4 has the compound scraped off the carrier back side 3, the adhesive coating 17 is applied at the end lap 16 section using an end lap adhesive applicator 29 and at the side lap 13 section using a selvage adhesive applicator 24. Immediately following the adhesive coating 17 applications, selvage film 12 and end lap film 15 are applied to the corresponding sections using selvage film applicator 27 and end lap film applicator 31, respectively.

Directly following these applications, surfacing agents 10 are applied using the surfacing applicator 26. After the surfacing application process, the composite sheet 2 undergoes cooling by traveling on a chilled water bath 30 and over cooling drums and typically is cooled to about 95 degrees Celsius. If granules are applied as surfacing agents 10, the roofing composite sheet 2 is continued through the production line over granular press rollers 33 in order to imbed the granules into the hot bituminous compound upper layer 1. After traveling through a series of turns and gears, the composite sheet 2 is inverted such that the upper-exposed surface 9 of the composite sheet 2 is now on the bottom side, and at about 160 degrees Celsius, the self-adhesive compound lower layer 7 is applied at the coating vat 32. Following the self-adhesive lower layer 7 application, the composite sheet 2 travels over a cooling belt to permit cooling of the self-adhesive compound. A release liner 19 is applied to the self-adhesive compound lower layer 7 using the release liner applicator 34. Then, the composite sheet 2 travels through the accumulator 36 to the winder 37 where it is cut to the required length and wound into rolls.

What is claimed is:

1. A roofing membrane comprising:

an upper layer of modified bituminous material modified with a modifier selected from the group consisting of: Atactic PolyPropylene (APP), Amorphous Poly Alpha Olefin (APOA), Thermoplastic PolyOlefin (TPO), Styrene-Butadiene-Styrene (SBS), Styrene-Ethylene-Butadiene-Styrene (SEBS), and synthetic rubber, said upper layer having a longitudinally extending side lap, a lower layer of self-adhesive bituminous material comprised of asphalt, filler, and tackifier, the lower layer having an exposed lower surface is adhesive throughout substantially said lower surface, the material of said lower layer being a material that differs from the material comprising the upper layer, a reinforcing layer disposed between the lower layer and the upper layer, a coating of factory applied adhesive being present on said side lap, said coating comprised of an adhesive selected from the group consisting of: tackifying resin, pressure sensitive adhesive, and Poly Vinyl Butyral (PVB), a release film covering said coating of factory applied adhesive, and a release liner covering said lower layer, whereby adjacent and successive overlapping membranes may be connected by the factory applied adhesive to form a seal and a permanent bond upon the application of pressure, such as by a roller.

2. A roofing membrane in accordance with claim 1 wherein, said upper layer of modified bituminous material is modified with APP, and said lower layer of self-adhesive bituminous material is comprised of asphalt, filler, tackifier and PVB.

3. A roofing membrane in accordance with claim 1, wherein said coating of adhesive is covered with a first removable selvage release film, and said upper layer has an end lap coated with factory applied adhesive in one or more strips each of which is covered with a second removable end lap release film, and said lower layer of self-adhesive bituminous material is covered with a release liner.

4. A roofing material in accordance with claim 3 wherein, said first and second films and said release liner are made of a material selected from the group consisting of siliconized polypropylene, siliconized polyester, and siliconized Kraft paper.

5. A roofing material in accordance with claim 1, wherein said upper layer of modified bituminous material is modified with APP, and said lower layer of self-adhesive bituminous material is comprised of asphalt, filler, and tackifier, and said first and said second coating of factory applied adhesive is a pressure-sensitive adhesive.

6. A roofing material in accordance with claim 1, wherein said upper layer of modified bituminous material is modified with SBS, and said first and said second coating of factory applied adhesive is a pressure-sensitive adhesive.

7. A roofing membrane in accordance with claim 1, wherein said first and said second coating of factory applied adhesive is a Styrene-Isoprene-Styrene rubber-based adhesive.

8. A roofing membrane in accordance with claim 3, wherein said strips of coating of factory adhesive are 0.5 inches to 1.5 inches in width each, and said strips on said side lap and said end lap comprise at least 40 grams of adhesive per 10 m of length of said membrane.

9. A roof covering as described in claim 1, wherein:

a surfacing agents is imbedded in said upper layer adjacent to said side lap.

10. A roofing membrane comprising:

an upper layer of modified bituminous material, said upper layer having a longitudinally extending side lap and a transversely extending end lap;

a lower layer of self-adhesive bituminous material, a first coating of factory applied adhesive being present on said side lap, a second coating of factory applied adhesive being present on said end lap, said first and second coating intersecting, a release film covering each of said first and second coating, and a release liner covering said lower layer, said upper layer of modified bituminous material being modified with a modifier selected from the group consisting of: Atactic PolyPropylene (APP), Amorphous Poly Alpha Olefin (APOA), Thermoplastic PolyOlefin (TPO), Styrene-Butadiene-Styrene (SBS), Styrene-Ethylene-Butadiene-Styrene (SEBS), and synthetic rubber, and said lower layer of self-adhesive bituminous material is comprised of asphalt, filler, tackifier and PVB, said lower layer being made of a material that differs from the material comprising the upper layer, a reinforcing layer disposed between the lower layer and the upper layer, said first and second adhesive coatings being comprised of an adhesive selected from the group consisting of: tackifying resin, pressure sensitive adhesive, and Poly Vinyl Butyral (PVB), and said first and second coating is applied in a plurality of strips along a side lap and an end lap of said upper layer of modified bituminous material, and said strips extending along said end lap are intersecting with strips extending along said side lap, said adhesive coated side lap of said upper layer is covered with a first removable selvage release film, and said adhesive coated end lap of said upper layer is covered with a second removable end lap release film, and said lower layer of self-adhesive bituminous material is covered with a release liner, and said first and second release films and said release liner being made of a material selected from the group consisting of siliconized polypropylene, siliconized polyester, and siliconized Kraft paper whereby adjacent and successive overlapping membranes may be connected by the factory applied adhesive to form a seal and a permanent bond upon the application of pressure, such as by a roller.

11. A roofing membrane in accordance with claim 10, wherein said first and second coating of factory applied adhesive are 0.5 inches to 1.5 inches in width each, and said coatings comprise at least 40 grams of adhesive per 10 m of length of said membrane.

12. A roof covering as described in claim 10, wherein:

a surfacing agents is imbedded in said upper layer adjacent to said end lap and said side lap.

* * * * *